US010201192B1

(12) United States Patent
Lott

(10) Patent No.: US 10,201,192 B1
(45) Date of Patent: Feb. 12, 2019

(54) SPORTS BRA

(71) Applicant: Chantelle Lott, Tulsa, OK (US)

(72) Inventor: Chantelle Lott, Tulsa, OK (US)

( * ) Notice: Subject to any disclaimer, the term of this patent is extended or adjusted under 35 U.S.C. 154(b) by 298 days.

(21) Appl. No.: 15/186,895

(22) Filed: Jun. 20, 2016

(51) Int. Cl.
*A41C 3/00* (2006.01)
*A41C 3/02* (2006.01)

(52) U.S. Cl.
CPC ..... *A41C 3/0057* (2013.01); *A41C 3/02* (2013.01)

(58) Field of Classification Search
CPC ..... A41C 3/00; A41C 3/0057; A41C 3/0028
USPC ..... 450/39, 86, 65, 59, 58, 62, 66, 67, 69, 450/74–76, 85, 2, 31, 34
See application file for complete search history.

(56) References Cited

U.S. PATENT DOCUMENTS 4,816,005 A * 3/1989 Braaten ..... A41C 3/0057 450/58
6,165,045 A * 12/2000 Miller ..... A41C 3/0057 450/1
7,435,155 B2 * 10/2008 Reinisch ..... A41C 3/0028 450/59
2009/0081924 A1 * 3/2009 Puyaubreau ..... A41C 3/0057 450/39
2013/0203319 A1 * 8/2013 Torres ..... A41C 3/0028 450/59
2015/0056890 A1 * 2/2015 Black ..... A41C 3/0057 450/86
2015/0223525 A1 * 8/2015 Miller ..... A41C 3/0057 450/65
2015/0342267 A1 * 12/2015 Lau ..... A41C 3/0057 450/66

FOREIGN PATENT DOCUMENTS

CN 101495005 A 7/2009

* cited by examiner

*Primary Examiner* — Gloria Hale
(74) *Attorney, Agent, or Firm* — Frank J. Catalano; Gable Gotwals

(57) ABSTRACT

A sports bra has base and cover layers of four-way stretchable material providing a first level of radial compression to the torso, a wide elastic band gripping the midriff to resist rotational and vertical motion of the bra relative to the torso and crisscrossed bands of elastic material spanning the back portion of the bra. Laterally-stretchable, vertically-shape-retaining foam panels overlap the base layer to support the breasts from below and power-mesh is sandwiched between the base and cover layers to increase radial compression of the breasts from above. The components all cooperate to limit bounce of the breasts during vigorous physical activity by the wearer. Adjustable shoulder straps and a zippered front are optional.

20 Claims, 6 Drawing Sheets

SPORTS BRA

BACKGROUND OF THE INVENTION

This invention relates generally to athletic wear for women and more particularly concerns bras, commonly known as sports bras, worn by women for support during moderate to vigorous activities.

Women participating in moderate to vigorous activities, including but not limited to athletics, have need for greater breast support than is afforded by known bras, even those said to be intended for athletic activities.

Common sense and life experience suggest that lack of adequate front support for the bust area may be the cause of pain in the bust area, and increasingly so for larger busted women. Similarly, lack of adequate back support may be the cause of pain in the back. However, back pain following vigorous activity may also be attributable, at least in part, to lack of adequate front support for the bust area, again increasingly so for larger busted women.

Sports bras have been designed which are intended to upgrade the support provided. Still, the continuing and common concern among women about the after-effects of "excessive bounce" suggests that each unique design is directed to correcting only the particular deficiencies of concern to its designer. Each woman's body being unique, any uniquely directed support may be of limited benefit to a very limited group of women. And some seemingly helpful solutions are not only insufficient but also counterproductive. For example, providing uplift to reduce bounce actually increases the range of bounce.

Not surprisingly, some women choose to wear multiple bras, hoping to gain the intended benefits of each by the combination. Obviously, the combinations will be bulkier and uncoordinated. Perhaps not so obviously, the combination may actually counteract the intended benefits of the unique designs.

SUMMARY OF THE INVENTION

In accordance with the invention, a sports bra is provided which has a horizontal band of elastic material of contracted length suitable to permit the band to securely grip a woman's midriff. A layer of four-way stretchable material extends upwardly from and connects the horizontal band to a segment of power-mesh material. The segment of power-mesh material is contoured to apply a level of downward compression to the upper portions of the woman's breasts. The layer of four-way stretchable material is contoured to snugly contain and apply a level of radial compression less than the level of radial compression applied by the power-mesh material to the portion of the woman's torso contained in the layer. The elastic band, the segment of power-mesh material and the layer of four-way stretchable material are co-operable to limit vertical bounce of the wearer's breasts during physical activity.

In a preferred embodiment, the sports bra has a base layer of four-way stretchable material, a cover layer of four-way stretchable material, an elastic midriff band and a segment of power-mesh material. The base layer is contoured to snugly contain the portion of a woman's torso which extends upwardly from a horizontal midriff plane to an ovate neckline. The cover layer of four-way stretchable material is co-extensive with, and is fixed along its perimeter, to the base layer. The base and cover layers provide one level of compression to the surrounded portions of the torso. The horizontal band of elastic material is sandwiched between the base and cover layers along the midriff plane and has a contracted length suitable to securely grip the midriff of the torso. The elastic band resists rotation and vertical movement of the bra relative to the torso. The segment of power-mesh material is sandwiched between the base and cover layers and is fixed along its perimeter to the cover layer. The power-mesh segment is contoured to compress the upper portions of the breasts at a higher level of compression than the layers. The base and cover layers, the midriff band and the segment of power-mesh material cooperate to limit vertical bounce of the wearer's breasts during physical activity.

Two other bands of elastic material may be crisscrossed and sandwiched between the portions of the base and cover layers which span the back of the wearer's torso. The crisscrossed bands extend from the neckline through their intersection to their corresponding points of intersection with the horizontal band and are fixed along their perimeters to the cover layer. The crisscrossed bands of elastic material further cooperate with the base and cover layers, the midriff band and the power-mesh material to limit vertical bounce of the wearer's breasts during physical activity.

The bra also has two shoulder straps, each one extending from the segment of power-mesh material to a corresponding one of the two crisscrossed bands. The shoulder straps cooperate with the base and cover layers, the midriff band, the power-mesh material and the crisscrossed bands to limit vertical bounce of the wearer's breasts during physical activity. The straps may be extensions of one or both of the base and cover layers, extensions of one or both of the base and cover layers backed by a soft segment of material or merely soft segments of material. They may also include buckles and hook-and-loop segments co-operable to permit adjustment of the length of the strap.

The bra may also have a panel of laterally-stretchable and vertically-shape-retaining foam. The foam panel overlays the base layer, extends upwardly from the upper edge of the horizontal band and is fixed at its lower and side edges to the base layer. The foam panel is contoured to support the breasts from below. It provides support for, but does not lift, the breasts. The panel further cooperates with the base and cover layers, the midriff band and the power-mesh material to limit vertical bounce of the wearer's breasts during physical activity.

The base and cover layers of material contain at least 60% nylon fibers and at least 10% spandex fibers and the power mesh material contains at least 60% nylon fibers and at least 25% spandex fibers, provided the power mesh material contains a greater percentage of spandex fibers than the base and cover layers of material. Preferably, the base and cover layers contain 80% nylon fibers and 20% spandex fibers and the power-mesh material contains 67% nylon fibers and 33% spandex fibers. Preferably, the midriff band is in a range of 3"+¼" wide and the crisscrossed bands are in a range of 2"+¼" wide.

Preferably, the front of the bra has a vertical, centered separation from the neckline to the midriff plane and a zipper for opening and closing the separation. If the separation and zipper are used, the front of the base and cover layers, the front of the midriff band, the power-mesh material and the foam panel are vertically bisected and preferably are all fixed together along opposite sides of the zipper.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

The Bra Generally

Figure 1:
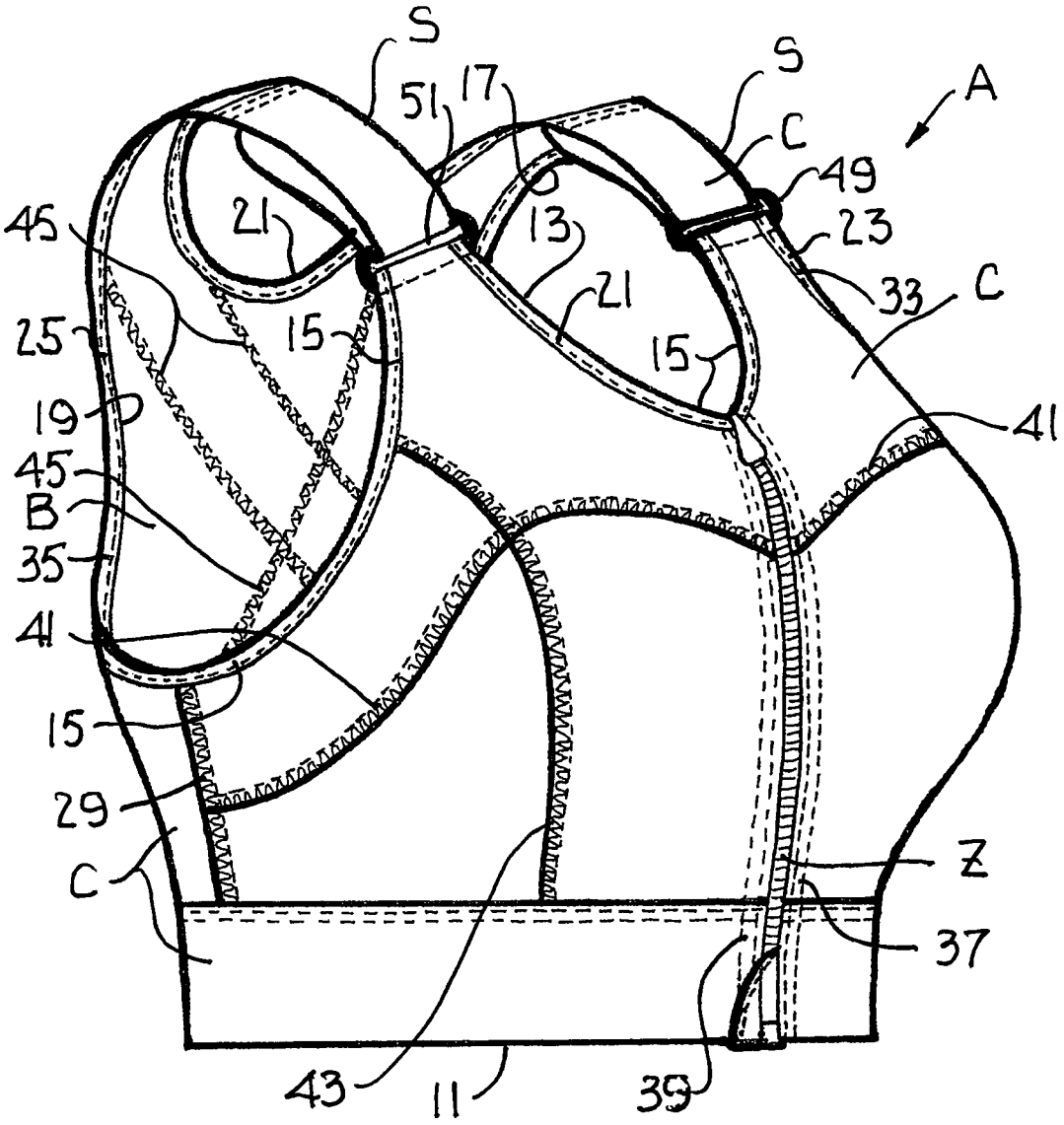
FIG. 1 is a perspective view of a sports bra according to the invention in a zipped, as-if-worn shape.
Figure 2:
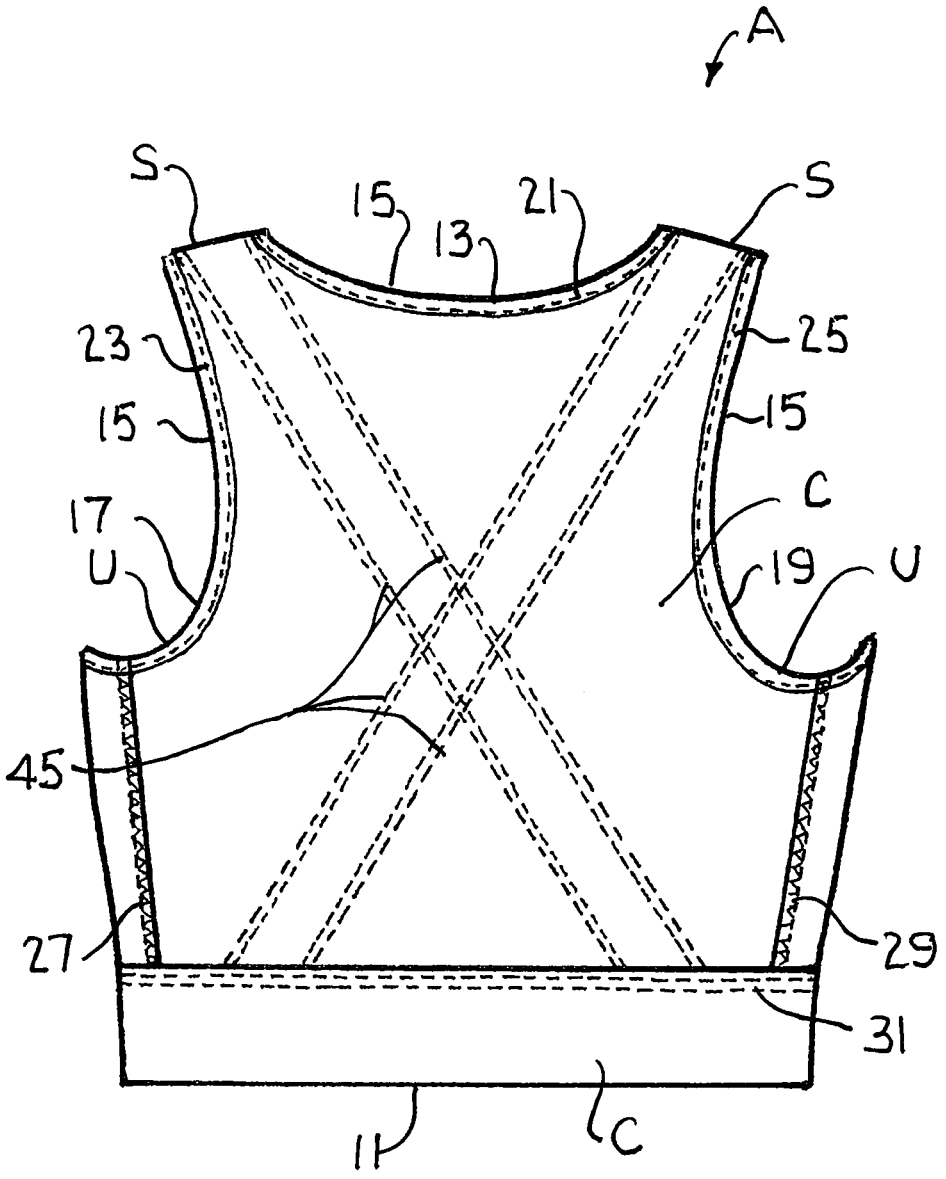
FIG. 2 is a rear elevation view of the sports bra of FIG. 1 in the zipped, as-if-worn shape.
Figure 3:
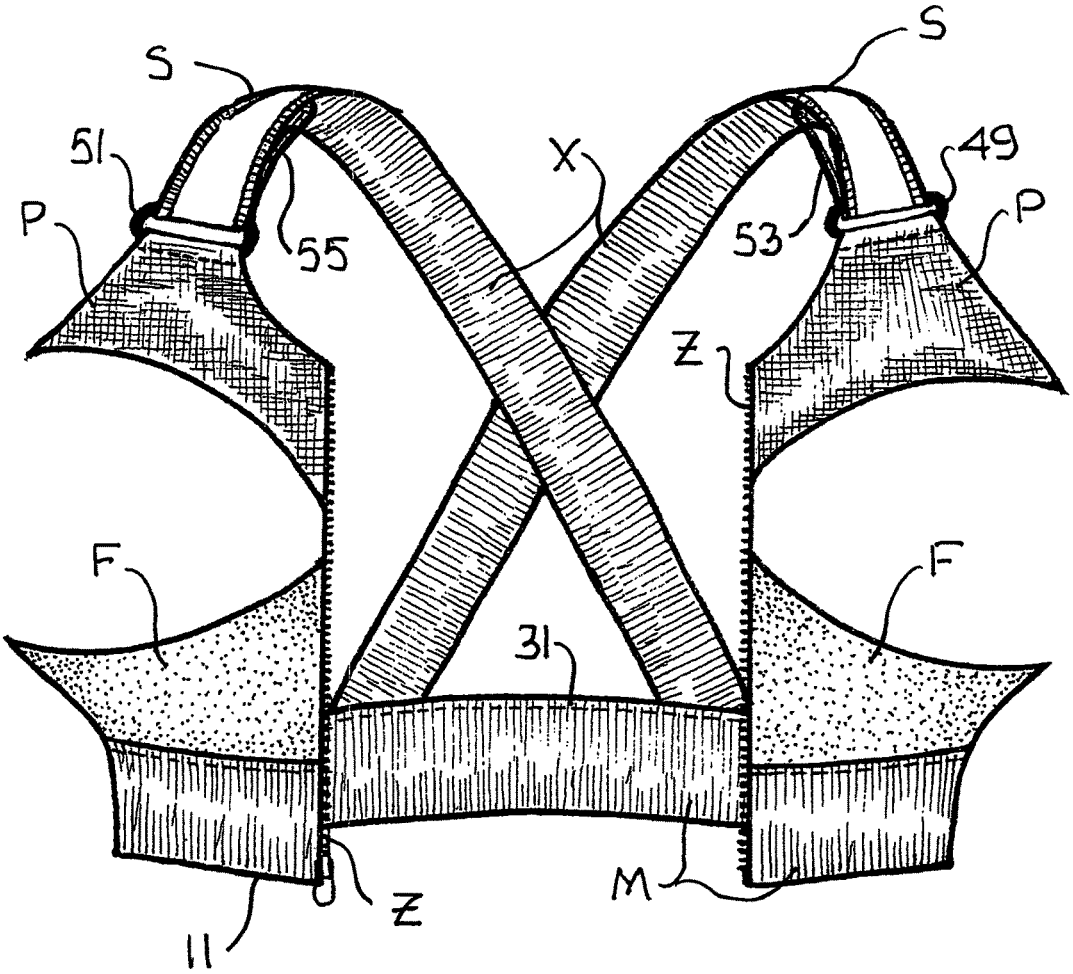
FIG. 3 is a front elevation view of the sports bra of FIG. 1 in an unzipped configuration with the base and cover layers of the bra removed.
Figure 4:
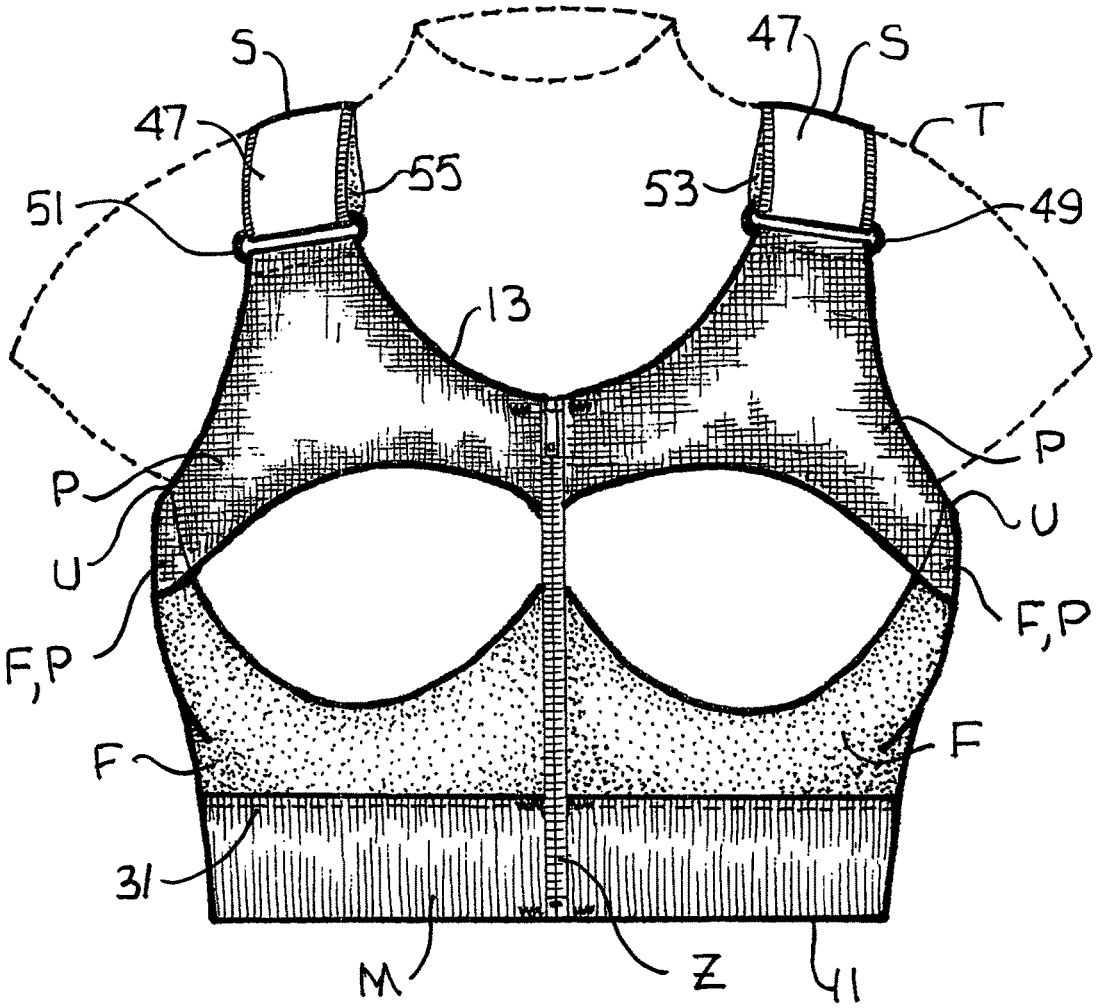
FIG. 4 is a front elevation view of the sports bra of FIG. 1 zipped on a torso but with the base and cover layers of the bra removed.
Figure 5:
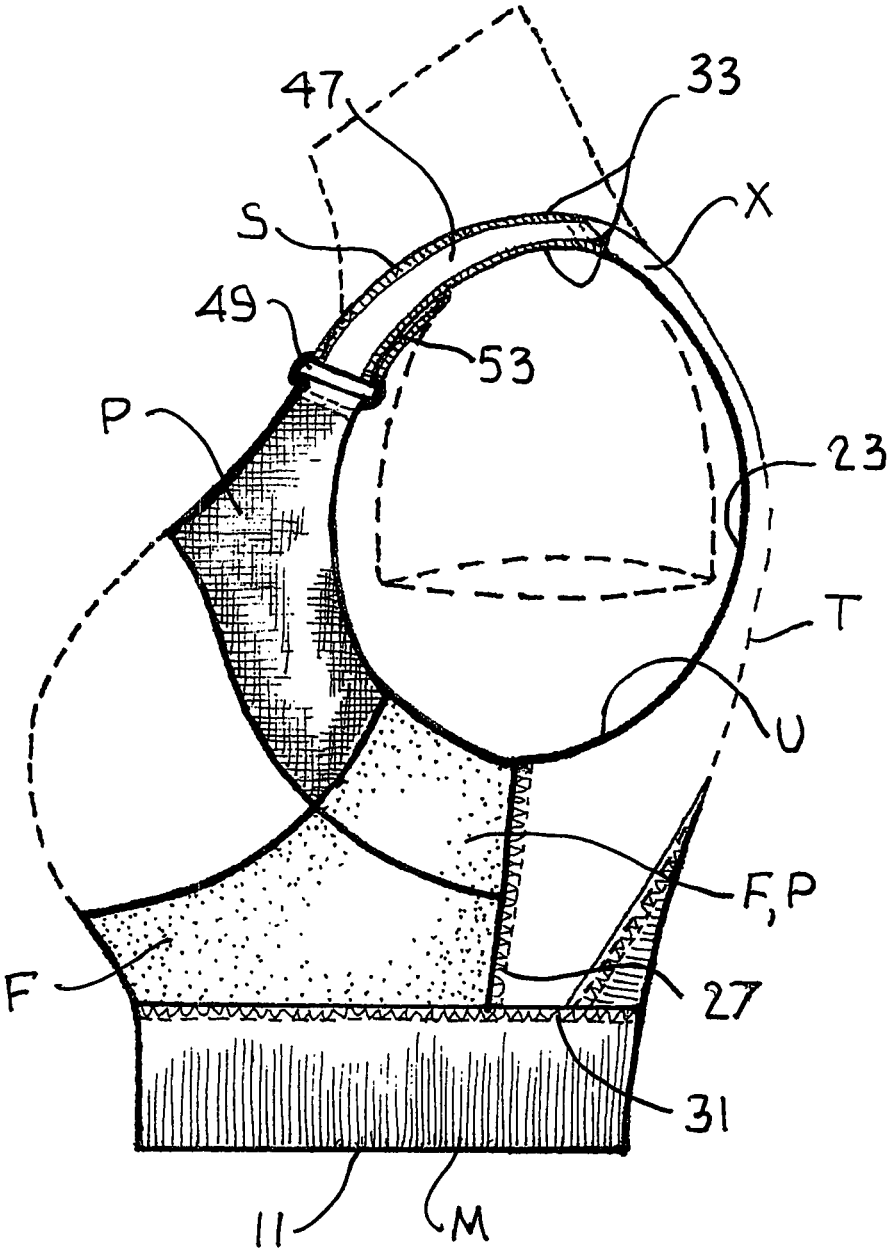
FIG. 5 is a left side elevation view of the sports bra of FIG. 1 zipped on a torso but with the base and cover layers of the bra removed.
Figure 6:
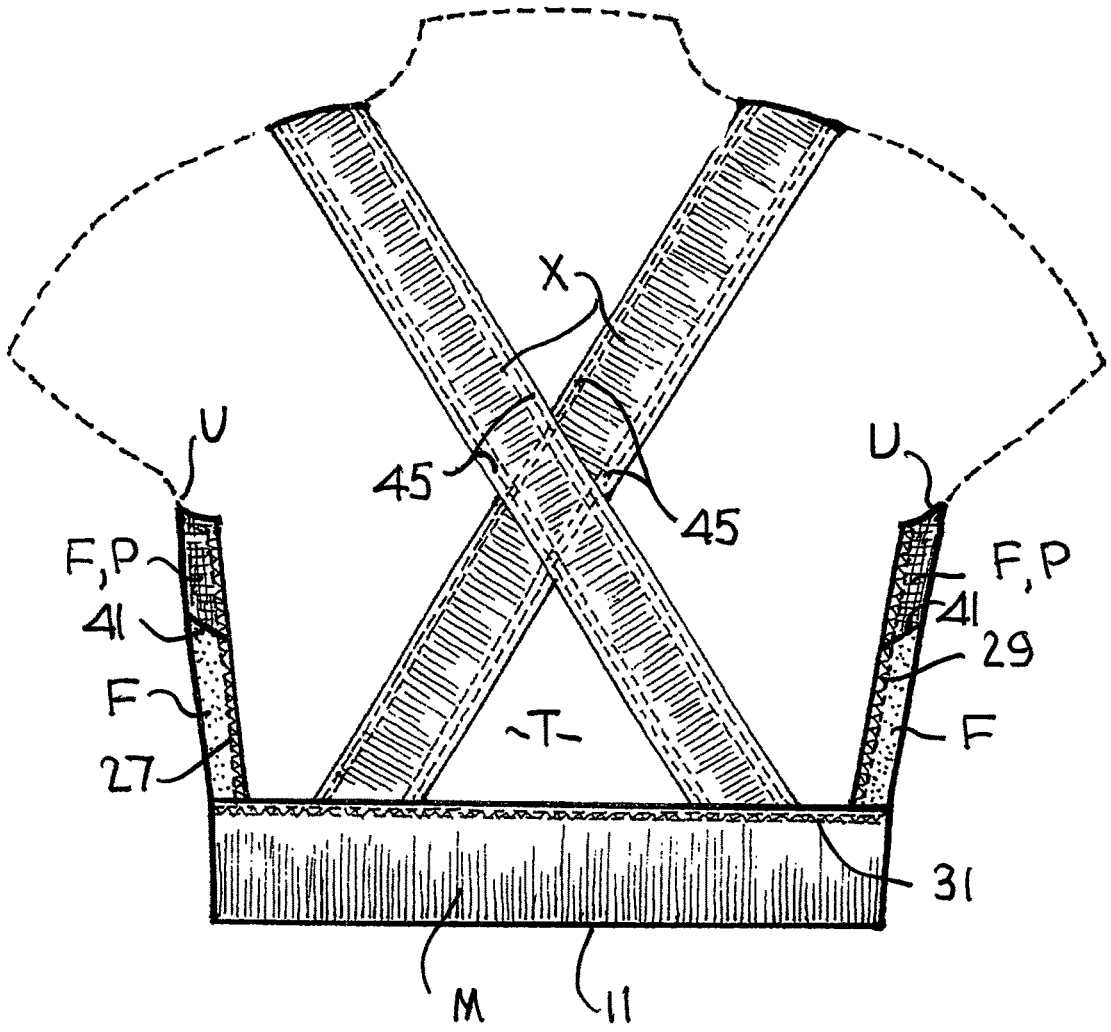
FIG. 6 is a rear elevation view of the sports bra of FIG. 1 zipped on a torso but with the base and cover layers of the bra removed.

Looking at FIGS. 1-6, a sports bra A is designed to limit bounce of a woman's breasts during vigorous physical activity. As seen in FIGS. 1 and 2, the bra A is fully assembled. In FIGS. 3 and 6, the bra A is shown with base and cover layers B and C of four-way stretchable material removed, revealing other bust-supporting components of the bra A. As seen in FIGS. 3-6, the bra A has a horizontal midriff band M of elastic of contracted length suitable to securely grip a woman's torso T and also to impede roll-up of the bra A at the midriff. As seen in FIGS. 3-5, a segment of power-mesh material P is contoured to apply radial compression to the upper portions of the breasts. And, as seen in FIG. 1, a layer B of four-way stretchable material extends upwardly from, and connects the horizontal band M to, the segment of power-mesh material P. The layer B is contoured to snugly contain and apply radial compression to the portion of the torso T contained in the layer B at a level less than the level of compression applied by the power-mesh material P. The band M, the segment of power-mesh material P and the layer B are co-operable to limit vertical bounce of the breasts during physical activity of the woman.

Continuing to look at the preferred embodiment shown in FIGS. 1-6, the sports bra A has a base layer B of four-way stretchable torso-surrounding material, seen in FIG. 1, a cover layer C of four-way stretchable material coextensive with the base layer B, seen in FIGS. 1-2, the elastic midriff band M, seen in FIGS. 3-6, and the front segment of power-mesh material P, seen in FIGS. 3-5. The bra A may also include two crisscrossed back-spanning elastic bands X, seen in FIGS. 3 and 6, shoulder straps S, seen in FIGS. 1-6, and a front panel of laterally stretchable and vertically shape-retaining foam F, seen in FIGS. 3-5. All of these components cooperate to limit vertical bounce of the breasts during physical activity of the wearer. As seen in FIGS. 1, 3 and 4, a front zipper Z may also be employed.

The Base and Cover Layers

In FIGS. 1 and 2, the sports bra A is seen in an as-if-worn shape. The base layer B of four-way stretchable material is contoured to snugly contain the portion of the woman's torso T which extends upwardly from the horizontal midriff plane 11 to an ovate neckline 13. The coextensive cover layer C of four-way stretchable material is fixed along its perimeter 15 to the base layer B. The base and cover layers B and C together provide a first level of compression to the contained portion of the torso T. As seen in FIGS. 1-2 and 4-6, ovate left and right arm openings 17 and 19 extend from corresponding shoulders S to corresponding underarms U. The neckline 13 and corresponding arm openings 17 and 19 also define the left and right shoulder straps S.

The four-way-stretchable character of the base and cover layers B and C, when snugly fitted on the torso T, applies a radially-inward compression to the contained portion of the torso T. This radial compression does afford some resistance to bounce.

The base and cover layers B and C are made of the same moisture-wicking and washable material, such as blends of nylon and spandex fibers. Preferably, the base and cover layers B and C of material contain at least 60% nylon fibers and at least 10% spandex fibers. Most preferably, the base and cover layers B and C contain 80% nylon fibers and 20% spandex fibers.

The Stitching

Continuing to look at FIGS. 1 and 2, the base and cover layers B and C can be further described in relation to stitching applied to either or both layers. The stitching may serve multiple purposes, including decorating, contouring and securing various components of the bra A. The base and cover layers B and C are secured to each other by neckline stitching 21, left and right arm opening stitching 23 and 25, left and right side stitching 27 and 29, midriff parallel plane stitching 31, left and right shoulder strap stitching 33 and 35 and, if a front zipper Z is employed, left and right vertical zipper stitching 37 and 39. Looking at the front of the bra A, the cover layer C exhibits sideways stitching 41 and height-wise stitching 43 which is not secured to the base layer B. Looking at the back of the bra A, the base layer B exhibits crisscrossed stitching 45 which is not secured to the cover layer C.

Comparing FIGS. 1-2 with FIGS. 3-6, the zipper stitching 37 and 39 fixes the zipper Z to the bra A. If a zipper Z is employed, the neckline stitching 21, arm opening stitching 23 and 25, side stitching 27 and 29 and the vertical zipper stitching 37 and 39 fix the power-mesh material P to the bra A. If the zipper Z is employed, the arm opening stitching 23 and 25, side stitching 27 and 29, midriff parallel plane stitching 31 and the zipper stitching 37 and 39 fix the foam panel F to the bra A. If no zipper is employed, the power-mesh material P and the foam panel F are not fixed at their center lines to the bra A. The crisscrossed stitching 45 fixes the crisscrossed bands X to the cover layer C of the bra A. And the shoulder strap stitching 33 and 35 is adapted to secure the shoulder strap components in accordance with the shoulder strap options hereinafter discussed.

The Midriff Band

Comparing FIGS. 1 and 2 with FIGS. 3-6, the horizontal midriff band M of elastic material is sandwiched between the base and cover layers B and C along the midriff plane 11 and extends from the midriff plane 11 of the bra A up to the midriff parallel perimeter stitching 31. As shown, the base layer B can be doubled over to cover both sides of the band M and the base and cover layers B and C are sewn to each other by the midriff parallel perimeter stitching 31, forming a pocket surrounding the midriff band M. The left and right ends of the band M may be secured to the base and cover layers B and C at their points of convergence with the left and right zipper stitching 37 and 39. Thus, the elastic midriff band M is free to stretch and contract between the base and cover layers B and C. Preferably, the elastic band M is between 2¾" and 3¼" wide and most preferably is 3" wide. The midriff band M is of length contractible to so snugly girt the midriff of the torso T as to resist movement the bra A vertically or rotationally in relation to the torso T.

The Power-Mesh Material

The segment of power-mesh material P is sandwiched between the base and cover layers B and C and is fixed along its perimeter to the cover layer C and contoured to provide additional radial compression to the upper portions of the breasts.

As seen in FIGS. 3-6, the power-mesh material P extends downward from the shoulder straps S, the neckline 13 and the arm openings 17 and 19 across an upper portion of the breasts of the torso T between the left and right side stitching 27 and 29 to the sideways stitching 41. The power-mesh material P is a segment of four-way stretchable material affording greater radial compression than the base and cover layers B and C of four-way stretchable material, providing a reinforced anti-bounce quality to resist upward motion of the breasts during activity of the wearer. Returning to FIG. 1, the power-mesh material P is sandwiched between the base and cover layers B and C and is secured in place at its ends by the left and right side stitching 27 and 29, at its upper neckline edge by the neckline stitching 21 and at its arm openings by the arm opening stitching 23 and 25. However, the power-mesh material P is secured at its lower edge to only the cover layer C by the sideways stitching 41. The power-mesh material P is not secured to the height-wise stitching 43 at all. The height-wise stitching 43 assists only in contouring the cover layer C of the bra A.

The power-mesh material P contains at least 60% nylon fibers and at least 25% spandex fibers, provided the power-mesh material P contains a greater percentage of spandex fibers than each of the base and cover layers B and C. Preferably, the power-mesh material P contains 67% nylon fibers and 33% spandex fibers.

The Crisscrossed Bands

Turning to FIGS. 1-3 and 6, two bands X of elastic material may be crisscrossed and sandwiched between the back-spanning portions of the base and cover layers B and C. Each band X extends from a corresponding shoulder S of the torso T through the intersection of the crisscrossed bands X proximate the center of the back-spanning portions of the base and cover layers B and C to their corresponding points of intersection with the parallel perimeter 31 of the midriff band M. Both bands are fixed along their perimeters to the cover layer. Preferably, the crisscrossed bands are in a range of 2"±¼" wide. The crisscrossed bands X provide back support and contribute to maintaining the power-mesh material P in a compressive orientation on the upper breast portion of the bra A.

The crisscrossed bands X of elastic material also cooperate with the base and cover layers C and D, the elastic midriff band M and the power-mesh material P to limit vertical bounce of the breasts during the wearer's physical activity.

The Shoulder Straps

As seen in FIGS. 1 and 3 and as noted above, the neckline 13 and arm openings 17 and 19 of the base and cover layers B and C may cooperate to define two shoulder straps S, each one extending from the segment of power-mesh material P to a corresponding one of the two crisscrossed bands X. However, the straps S may include only one of the base and cover layers B and C, one or both of the base and cover layers B and C backed by a soft segment 47 of material or by only soft segments 47 of material.

As shown in FIGS. 1 and 3-5, the straps also preferably have left and right buckles 49 and 51 hook-and-loop segments 53 and 55 which connect the free ends of the straps S to the power-mesh material P of the bra A and are co-operable with corresponding hook-and-loop segments 53 and 55 on the free ends of the straps S to permit adjustment of the lengths of the straps S. The buckles 49 and 51 may be made of metal or plastic and are preferably 1½" wide. Alternatively, the shoulder straps S can be unitary and non-adjustable.

The Foam Panel

As seen in FIGS. 3-6, the bra A may also have a panel of laterally-stretchable and vertically-shape-retaining foam F. The foam panel F is contoured to support the breasts from below. The panel F overlays the base layer B and extends upwardly from the parallel perimeter 31 of the midriff band M and is fixed at its lower and side perimeters to the base layer B. The foam panel F provides support for, but does not lift, the breasts. The foam panel F opposes downward motion of the breasts. The panel is preferably polyester foam.

The foam panel F also cooperates with the base and cover layers B and C, the elastic midriff band M and the power-mesh material P to limit vertical bounce of the breasts during physical activity of a wearer.

As best seen in FIGS. 4, 5 and 6, the foam panels F and power-mesh material P overlap at the upper side portions of the foam panel F. However, the power-mesh material is sandwiched between the base and cover layers C and D while the foam panel F is sandwiched between the base layer B and the torso T.

The Zippered Separation

Preferably, the front of the bra A has a vertical, centered separation from the neckline 13 to the midriff plane 11 and a zipper Z for opening and closing the separation. If a zipper Z is used, the front of the base and cover layers B and C, the front of the midriff band M, the power-mesh material P and the foam panel F are vertically bisected and preferably are all fixed together along opposite sides of the zipper Z. Molded 12" separating zippers work satisfactorily. Closures other than zippers, such as arrays of hook-and-eye connectors, could be used. Alternatively, the bra A could be a pullover.

Thus, it is apparent that there has been provided, in accordance with the invention, a sports bra that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A sports bra comprising:

a base layer of four-way stretchable material contoured to snugly contain a portion of a woman's torso extending upwardly from a horizontal midriff plane of the bra to an ovate neckline of the bra;

a cover layer of four-way stretchable material co-extensive with and fixed along its perimeter to said base layer;

a horizontal band of elastic material sandwiched between said base and cover layers along said midriff plane of the bra, said horizontal band having a contracted length suitable to securely grip the midriff of the torso of the woman; and a segment of power-mesh material sandwiched between said base and cover layers, fixed along its perimeter to said cover layer and contoured to compress upper portions of the breasts of the torso of the woman, said base and cover layers, said horizontal band and said segment of power-mesh material being co-operable to limit vertical bounce of the breasts of the torso of the woman during physical activity of a wearer.

2. A sports bra according to claim 1, said base and cover layers of material comprising at least 60% nylon fibers and at least 10% spandex fibers, said power mesh material comprising at least 60% nylon fibers and at least 25% spandex fibers, and said power mesh material comprising a greater percentage of spandex fibers than said base and cover layers of material.

3. A sports bra according to claim 2, said base and cover layers comprising 80% nylon fibers and 20% spandex fibers and said power-mesh material comprising 67% nylon fibers and 33% spandex fibers.

4. A sports bra according to claim 1, a front of said bra having a vertical, centered separation from said neckline to said horizontal midriff plane of the bra, the bra further comprising a zipper for opening and closing said separation.

5. A sports bra according to claim 1 further comprising two bands of elastic material crisscrossed and sandwiched between back-spanning portions of said base and cover layers and fixed along their perimeters to said cover layer with each said band extending from said ovate neckline through an intersection of said crisscrossed bands to a corresponding point of intersection thereof with said horizontal band, said crisscrossed bands of elastic material being further co-operable with said base and cover layers and said horizontal midriff band to limit vertical bounce of the breasts of the torso of the woman during physical activity of a wearer.

6. A sports bra according to claim 5, said crisscrossed bands being in a range 2"+¼" wide.

7. A sports bra according to claim 5 further comprising two shoulder straps, one said shoulder strap extending between said segment of power-mesh material and a corresponding one of said two crisscrossed bands, whereby said shoulder straps are co-operable with said base and cover layers, said horizontal midriff band and said crisscrossed bands to limit vertical bounce of the breasts of the torso of the woman during physical activity of a wearer.

8. A sports bra according to claim 7, each said shoulder strap comprising any one of:

a. an extension of any one of said base and cover layers;

b. an extension of any one of said base and cover layers backed by a soft segment of material; and c. a soft segment of material.

9. A sports bra according to claim 8, each said shoulder strap further comprising a buckle and hook-and-loop segment co-operable to permit adjustment of a length of said strap.

10. A sports bra according to claim 1 further comprising a panel of laterally-stretchable and vertically-shape-retaining foam, said panel being contoured to support an underside of the breasts of the torso of the woman, said panel overlaying said base layer and extending upwardly from an upper edge of said horizontal band and being fixed at lower and side perimeters thereof to said base layer, whereby said panels provide support for corresponding breasts of the torso of the woman, said panels being further co-operable with said base and cover layers and said horizontal midriff band of the bra to limit vertical bounce of the breasts during physical activity of a wearer.

11. A sports bra according to claim 1, said horizontal midriff band being in a range of 3"+¼" wide.

12. A sports bra comprising:

a base layer of four-way stretchable material contoured to snugly contain a portion of a woman's torso extending upwardly from a horizontal midriff plane of the bra to an ovate neckline of the bra;

a cover layer of four-way stretchable material, said cover layer being co-extensive with said base layer;

a horizontal band of elastic material sandwiched between said base and cover layers at said horizontal midriff plane of the bra, said horizontal band having a contracted length suitable to securely grip the midriff of the woman's torso;

two panels of laterally-stretchable and vertically shape-retaining foam, each said panel being contoured to support an underside of a corresponding breast of the woman's torso, each said panel overlaying said base layer, extending upwardly from an upper edge of said horizontal band and fixed at lower and side perimeters thereof to said base layer, whereby said panels provide support for corresponding breasts of the woman's torso;

a segment of power-mesh material sandwiched between said base and cover layers, fixed along its perimeter to said cover layer and contoured to compress the upper portions of the breasts of the woman's torso;

two bands of elastic material crisscrossed and sandwiched between torso-back portions of said base and cover layers fixed along their perimeters to said cover layer, each said band extending from said ovate neckline of the bra through an intersection of said crisscrossed bands to a corresponding point of intersection with said horizontal midriff band of the bra;

said base and cover layers, said horizontal midriff band, said crisscrossed bands, said foam panels and said power-mesh material being co-operable to limit vertical bounce of the breasts of the woman's torso during physical activity of a wearer.

13. A sports bra according to claim 12, said base and cover layers of material comprising at least 60% nylon fibers and at least 10% spandex fibers, said power mesh material comprising at least 60% nylon fibers and at least 25% spandex fibers, and said power mesh material comprising a greater percentage of spandex fibers than said base and cover layers of material.

14. A sports bra according to claim 13, said base and cover layers comprising 80% nylon fibers and 20% spandex fibers and said power-mesh material comprising 67% nylon fibers and 33% spandex fibers.

15. A sports bra according to claim 12, a front of said bra having a vertical, centered separation from said ovate neckline of the bra to said horizontal midriff plane of the bra, the bra further comprising a zipper for opening and closing said separation.

16. A sports bra according to claim 12 further comprising two shoulder straps, one said shoulder strap extending between said segment of power-mesh material and a corresponding one of said two crisscrossed bands, whereby said shoulder straps are co-operable with said base and cover layers, said horizontal midriff band and said crisscrossed bands to limit vertical bounce of the breasts of the woman's torso during physical activity of a wearer.

17. A sports bra according to claim 16, each said shoulder strap comprising any one of:

a. an extension of any one of said base and cover layers;

b. an extension of any one of said base and cover layers backed by a soft segment of material; and c. a soft segment of material.

18. A sports bra according to claim 17, each said shoulder strap further comprising a buckle and hook-and-loop segment co-operable to permit adjustment of a length of said strap.

19. A sports bra according to claim 12, said horizontal midriff band being in a range of 3"+¼" wide and said crisscrossed bands being in a range of 2"+¼" wide.

20. A sports bra comprising:

a horizontal band of elastic material having a contracted length suitable to permit said band to securely grip a woman's midriff;

a segment of power-mesh material sized and contoured to apply a first level of radial compression to upper portions of the woman's breasts; and at least one layer of four-way stretchable material extending upwardly from said horizontal band and connecting said horizontal band to said segment of power-mesh material, said at least one layer being sized and contoured to snugly contain a portion of the woman's torso therein and apply a second level of radial compression less than said first level of radial compression to the portion of the woman's torso contained therein, said horizontal band, said segment of power-mesh material and said at least one layer being co-operable to limit vertical bounce of the woman's breasts during physical activity of the woman.

* * * * *